US005898367A

United States Patent [19]

Berube

[11] Patent Number: 5,898,367

[45] Date of Patent: Apr. 27, 1999

[54] PERSONAL SECURITY SYSTEM WITH WEIGHTED RECEIVER LOCATIONS

[75] Inventor: James Edward Berube, Fairport, N.Y.

[73] Assignee: Detection Systems, Inc., Fairport, N.Y.

[21] Appl. No.: 08/763,644

[22] Filed: Dec. 11, 1996

[51] Int. Cl.[6] ..... G08B 26/00

[52] U.S. Cl. ..... 340/505; 340/539; 340/825.36; 340/825.49; 340/573.1

[58] Field of Search ..... 340/505, 539, 340/825.36, 825.45, 573; 455/10, 226.2, 53.1, 49.1

[56] References Cited

U.S. PATENT DOCUMENTS

| | | | |
|---|---|---|---|
| 4,611,198 | 9/1986 | Levinson et al. | 340/539 |
| 4,630,035 | 12/1986 | Stahl et al. | 340/539 |
| 4,694,282 | 9/1987 | Tamura et al. | 340/539 |
| 4,764,757 | 8/1988 | DeMarco et al. | 340/574 |
| 4,918,437 | 4/1990 | Jasinski et al. | 340/825.44 |
| 4,998,095 | 3/1991 | Shields | 340/574 |
| 5,115,224 | 5/1992 | Kostusiak et al. | 340/574 |
| 5,223,816 | 6/1993 | Levinson et al. | 340/539 |
| 5,365,217 | 11/1994 | Toner | 340/539 |
| 5,396,224 | 3/1995 | Dukes et al. | 340/825.49 |
| 5,416,466 | 5/1995 | Malvaso et al. | 340/539 |
| 5,467,074 | 11/1995 | Pedtke | 340/539 |

*Primary Examiner*—Edward Lefkowitz
*Assistant Examiner*—Daryl C. Pope
*Attorney, Agent, or Firm*—J. Addison Mathews

[57] ABSTRACT

A personal security system uses conversion factors that exaggerate the influence of signal strength to locate transmitting communicators. The system includes an alarm center, portable communicators for transmitting wireless signals and a plurality of fixed receivers in known positions for monitoring the transmissions and detecting the signals. Transmitted information, including signal strength, is forwarded from the receivers to the alarm center. A transmitting communicator is located by the system using the known positions and received signal strength at the detecting receivers. Conversion factors that increase with signal strength magnify its influence, so strong signals dominate the locating calculations. In addition to a calculated location of the transmitting communicator, the alarm center displays the location of a plurality of the detecting receivers, selecting between alternative displayed information depending on a comparison of the received signal strengths.

2 Claims, 8 Drawing Sheets

| HEX REPORTED LEVEL | DECIMAL CONVERTED LEVEL | DECIMAL SUB-LEVEL |
|---|---|---|
| 01-0F | 0 | 0 |
| 10-1F | 1 | 0 |
| 20-2F | 2 | 0 |
| 30-3F | 3 | 0 |
| 40-4F | 4 | 0 |
| 50-5F | 5 | 0 |
| 60-6F | 6 | 0 |
| 70-7F | 8 | 0 |
| 80-8 | 10 | 0 |
| 90-9F | 13 | 0 |
| A0-AF | 16 | 1 |
| B0-BF | 32 | 2 |
| C0-CF | 64 | 4 |
| D0-DF | 128 | 8 |
| E0-EF | 256 | 16 |
| F0-FF | 512 | 32 |

| STRONGEST RECEIVE LEVEL FOR THIS ALARM | TEXT DISPLAYED FOR THESE RECEIVE LEVELS |
|---|---|
| 0-0F | 01-0F |
| 10-1F | 01-1F |
| 20-2F | 01-2F |
| 30-3F | 01-3F |
| 40-4F | 01-4F |
| 50-5F | 10-5F |
| 60-6F | 20-6F |
| 70-7F | 30-7F |
| 80-8F | 40-8F |
| 90-9F | 50-9F |
| A0-AF | 60-AF |
| B0-BF | 78-BF |
| C0-CF | 90-CF |
| D0-DF | A8-DF |
| E0-EF | C0-EF |
| F0-FF | D0-FF |

FIG. 11

PERSONAL SECURITY SYSTEM WITH WEIGHTED RECEIVER LOCATIONS

DESCRIPTION

1. Field of Invention

The invention relates to a personal security system for locating emergency transmissions. More specifically the invention pertains to such a system including portable communicators actuated in emergencies to transmit wireless signals that are used by monitoring devices to locate and display the location of the transmitting communicator. Still more specifically, the invention relates to such a system that uses the strength of the wireless signals to locate the communicator transmissions.

2. Background of the Invention

Recently developed personal security systems locate subscribers in an emergency. The systems are installed in a protected region, such as a college or hospital campus, shopping center or building complex, and display the location of the emergency on a monitor at an alarm center.

A typical system is based on a portable transmitter carried by a subscriber and actuated in an emergency to send radio frequency signals identifying the transmitter to the system. Fixed receivers are installed at predetermined locations throughout the protected region. The receivers detect emergency transmissions and relay the transmitted information to the alarm center. The alarm center identifies the subscriber to whom the transmitter is assigned, locates the emergency based on the receivers that detect the transmission and displays the location for appropriate security personnel. Examples of these and similar systems are disclosed in Shields U.S. Pat. No. 4,998,095, issued Mar. 5, 1991; DeMarco U.S. Pat. No. 4,764,757, issued Aug. 16, 1988; Levinson U.S. Pat. No. 4,611,198, issued Sep. 9, 1986 and Toner Patent No. 5,365,217, issued Nov. 15, 1994.

Improved approaches for locating an emergency transmission are disclosed in Kostusiak et al. U.S. Pat. No. 5,115,224, issued May 19, 1992, Malvaso et al. U.S. Pat. No. 5,416,466, issued May 16, 1995 and Pedtke U.S. Pat. No. 5,467,074, issued Nov. 14, 1995. In addition to the known positions of the detecting receivers, Kostusiak, Malvaso and Pedtke use relative signal strength between several detecting receivers to more accurately locate the emergency transmission.

While existing approaches provide many advantages in personal security systems, further important improvements will become apparent from the present specification.

SUMMARY OF THE INVENTION

The present invention is directed to improvements in personal security systems that more accurately locate transmissions and provide better information to those responding.

Briefly summarized, according to one aspect of the invention, a personal security system uses conversion factors that exaggerate the influence of signal strength to locate transmitting communicators. The system includes an alarm center, portable communicators for transmitting wireless signals and a plurality of fixed receivers in known positions for monitoring the transmissions and detecting the signals. Transmitted information, including signal strength, is forwarded from the receivers to the alarm center. A transmitting communicator is located by the system using the known positions and received signal strength at the detecting receivers. Conversion factors that increase with signal strength magnify its influence, so strong signals dominate the locating calculations.

According to more specific features of this aspect, the wireless signal includes a communicator identification, the forwarded information includes the communicator identification and the alarm center reports the identification with the location.

Other aspects of the invention involve the manner in which the transmitting communicator location is reported or displayed. In addition to a calculated location of the transmitting communicator, the alarm center displays the location of a plurality of the detecting receivers, selecting between alternative displayed information depending on a comparison of the received signal strengths. The displayed receiver information includes text, and the alternative information includes text pertaining to: a) a predetermined number of said detecting receivers; b) a number of said detecting receivers less than said predetermined number when said signal strengths of said predetermined number vary by more than predetermined amounts; and c) a number of said detecting receivers more than said predetermined number when said signal strengths of said predetermined number vary by less than predetermined amounts. If two strong signals are detected with a weak signal, only the receivers of the strong signals are identified in the text. If several receivers detect the same signal strength, text is displayed for all that fit in the available area even if the number is greater than otherwise would be reported.

These and other features and advantages of the invention will be more clearly understood and appreciated from a review of the following detailed description of the preferred embodiments and appended claims, and by reference to the accompanying drawings.

BRIEF DESCRIPTION OF THE DRAWINGS

FIG. 11 is a chart of predetermined signal strengths used for selecting between alternative displayed information at the alarm center according to the preferred embodiment.

DETAILED DESCRIPTION OF THE INVENTION

Figures 1, 2:
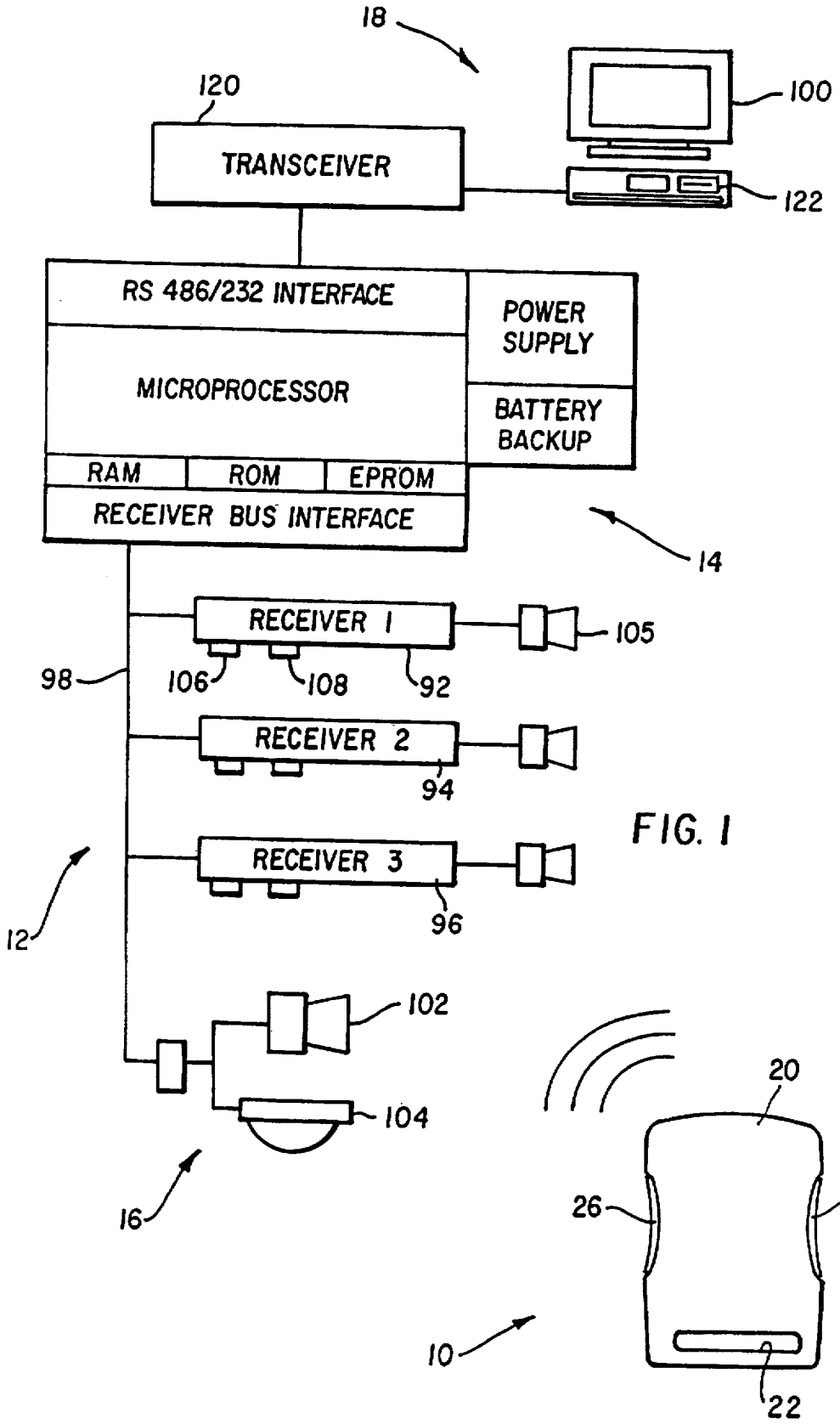
FIGS. 1 and 2 are schematic views of a personal security system in accordance with a preferred embodiment of the invention including portable communicators, fixed receivers, local controllers and an alarm center.

Referring now to FIGS. 1 and 2, a preferred embodiment of the invention is depicted in a personal security system including hand-portable communicators 10, fixed receivers 12, local controllers 14, alarms 16 and an alarm center 18.

The communicators 10 are carried by subscribers to the system for actuation in emergency or threatening situations to initiate planned events that scare away attackers and call for assistance. When actuated, the communicator transmits wireless signals to the surrounding area, at predetermined frequency and signal strength, including a code that identifies the communicator to the system.

Receivers 12 monitor the protected region for transmissions and, in combination with local controller 14 and alarm center 18, initiate the planned events. The receivers detect and decode information from each transmission, including the identification of the transmitting communicator and the strength of the received signal. The identification and strength information is stored in the receiver for retrieval by the local controllers 14, which repeat or forward the retrieved information to alarm center 18. The alarm center uses the forwarded information to determine the location of the transmitting communicator and the name of the subscriber to which the communicator is assigned. Alarms 16 are actuated in the vicinity of the determined location, and security personnel are dispatched to that location for assistance.

Once actuated to transmit an emergency signal, the communicator 10 repeats the transmissions, preferably once every thirty seconds, for a predetermined time interval, preferably fifteen minutes. The alarm center 18 uses the signal repetitions to track and display any movement of the transmitter associated, for example, with fleet from an attacker.

Communicators and Transmitted Signal

Figure 3:
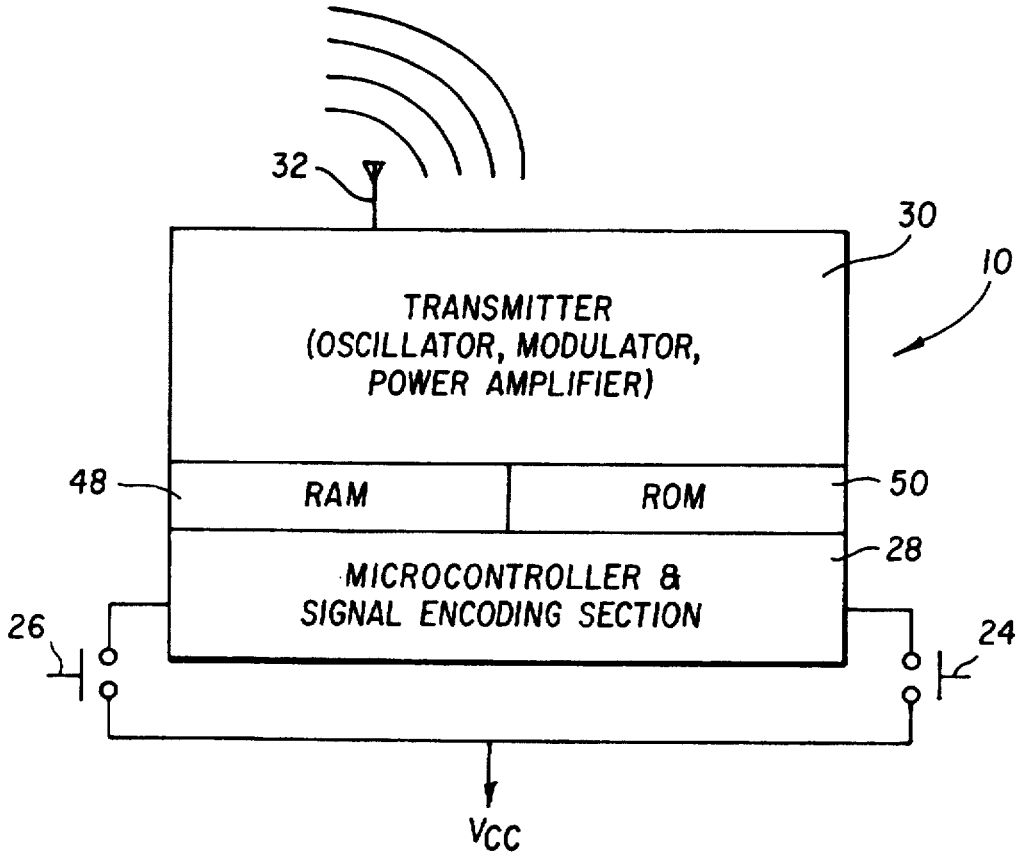
FIG. 3 is a schematic diagram of the portable communicator of the preferred embodiment.

The hand-portable communicator 10, most clearly shown in FIGS. 2 and 3, is battery powered and adapted for convenient carrying in a purse or pocket. It is enclosed in a plastic case 20 including a key ring 22 and two switches depicted as depressable buttons 24 and 26. The switches are designed for actuation from opposite sides of the case 20 against a spring bias and in sequences that normally prevent accidental operation.

The switches 24 and 26 initiate operation of the communicator, either in an alarm state or a test state, depending on the sequence of actuation. In both cases, alarm and test, the communicator produces and transmits a radio frequency signal to the local geographic area at a predetermined frequency and signal strength. The frequency may be in the three hundred or nine hundred megahertz range typical for such applications. The signal strength is chosen in combination with the number and locations of fixed receivers 12 so more than one and preferably at least three receivers typically will be able to detect the transmitted signal for the purposes to be described. At the same time, the signal strength, which falls off with the inverse square of the distance, should be weak enough to facilitate the location of the transmission based on differences in the signal strength at the detecting receivers.

Figure 4:
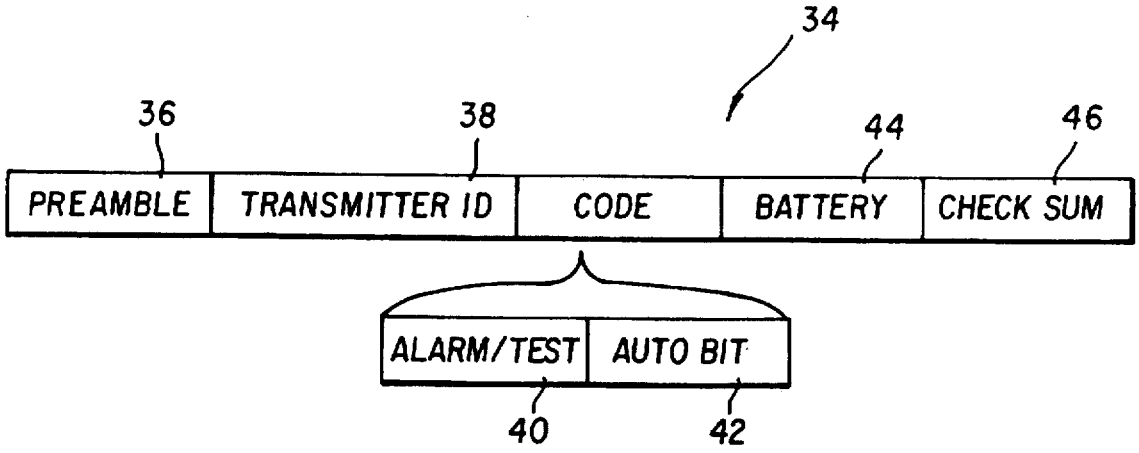
FIG. 4 is a schematic diagram of a signal packet transmitted by the communicator according to the preferred embodiment.

Actuation of the switches 24 and 26, in either an alarm or a test mode, causes a microcontroller 28 (FIG. 3) to initiate operation of a transmitter 30, sending the radio frequency signals through antenna 32 to the local geographic area. The transmitted signal, sometimes referred to as a signal stream, includes a series of eight identical packets of information 34 (FIG. 4) having an irregular spacing in the stream to reduce the risk of jamming with other possible transmissions. The packets take approximately sixteen milliseconds to transmit, with approximately one hundred milliseconds between packets. A signal stream of eight packets takes approximately one second to transmit. Each packet contains the information identified on FIG. 4, including a preamble 36, a user or transmitter identification (ID) code 38, an alarm or test code 40, a tracking bit 42, a low-battery warning bit 44, and a check sum 46 for error detection. Appropriate memory 48 and 50 (FIG. 3) are included in the communicator to support the microcontroller in carrying out its various functions.

The transmitter ID code 38 is programmed and stored in memory 48 or 50, either at the time of manufacture or when the user subscribes to the system. The alarm or test code 40 is determined by the manner in which switches 24 and 26 are actuated. Simultaneous actuation of the switches 24 and 26 sets the code to indicate an alarm. Sequential actuation, first one switch and then the other, sets the code to indicate a test. The tracking bit 42 is set by the microcontroller 28. For reasons that will become more apparent from the following description, on the first or manually initiated transmission of an alarm, the tracking bit 42 is cleared to indicate the first transmission. During subsequent automatic transmissions, however, the tracking bit is set.

Figure 5:
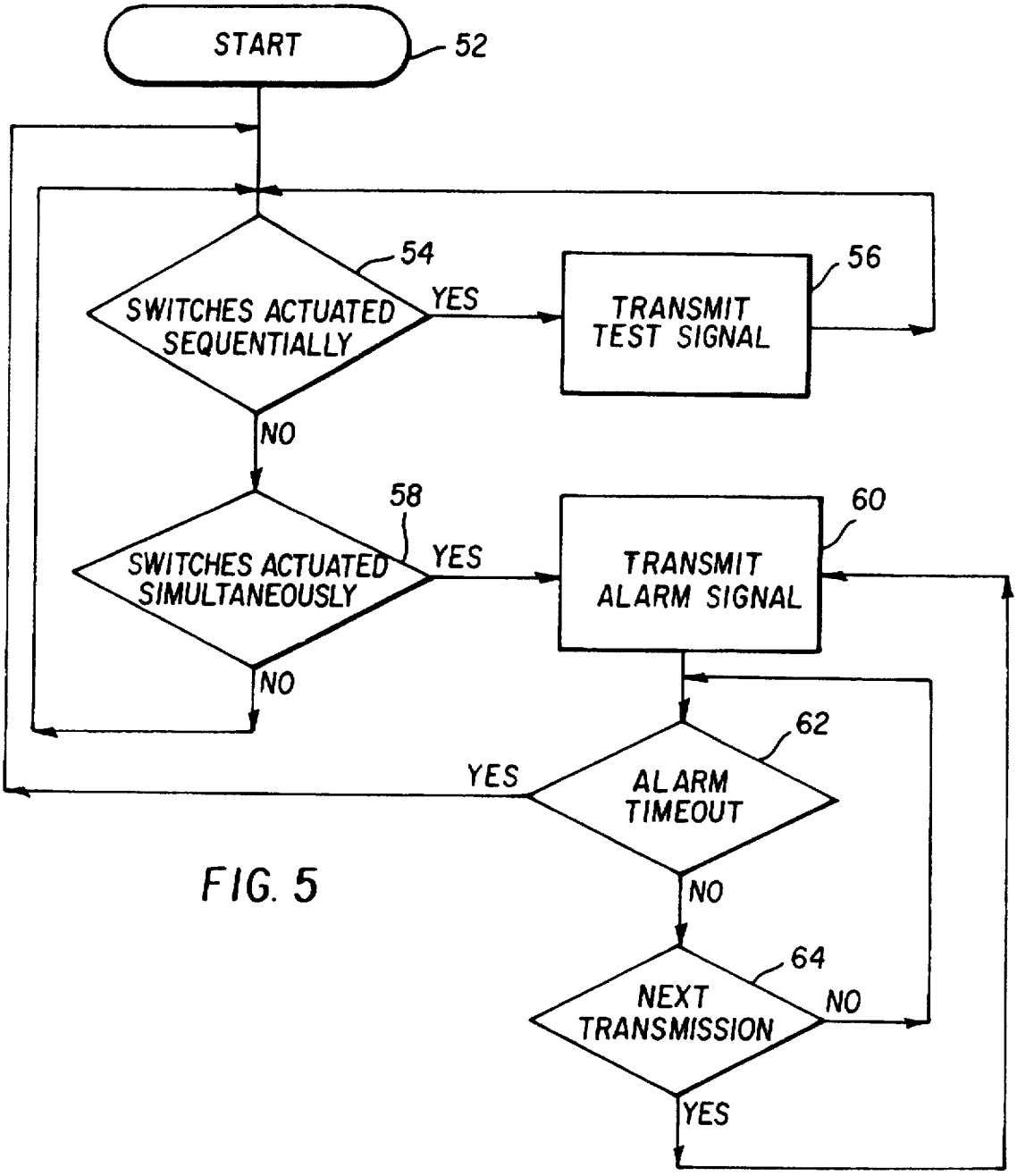
FIG. 5 is a flow diagram summarizing the operation of the preferred communicator.

FIG. 5 summarizes the operation of the portable communicator, which will be described in combination with FIGS. 1–4. Beginning at 52, the switches 24 and 26 are actuated sequentially to initiate a test, boxes 54 and 56, or simultaneously to initiate an alarm, boxes 58 and 60. Microcontroller 28 operates transmitter 30 to send the signal packet 34 with the alarm/test code 40 set to appropriately indicate a test or an alarm in accordance with the mode of switch operation. For a test, the multi-packet signal stream is transmitted only once. For an alarm, on the other hand, the multi-packet signal stream is transmitted repeatedly, such as more frequently than once a minute, for a predetermined time interval of at least five minutes, and preferably at least ten minutes. In this preferred embodiment the transmissions are repeated approximately every thirty seconds for approximately fifteen minutes. The alarm signal repetitions are depicted at 60, 62 and 64.

Further details of transmitter operation, particularly in connection with the signal repetitions and alarm tracking features, are disclosed in Berube and Reed patent application Seri. No. 08/635,986, filed Apr. 22, 1996.

Receivers, Alarms and Local controllers

The receivers 12 (FIG. 1) include a plurality of receivers, exemplified by 92, 94 and 96, spaced at predetermined fixed locations throughout the protected area. Each respective receiver is tuned to continuously monitor the predetermined frequency used by the portable transmitters. They decode transmitter signals, validate the transmission for proper format, sample the strength of validated signals and set a normal/off-normal bit flag depending on the information received. A decoded transmission, assuming it is in the proper format, is stored in a data register, including the received signal strength, the identification number of the portable transmitter and the state of the normal/off-normal flag bit.

The receivers communicate with the associated local controller 14 through a multiplex bus interface 98. The local controller 14 queries each respective receiver using a unique receiver address code. If the flag bit is normal, the control center 14 continues with queries cycled to other receivers. If the flag bit is off-normal, indicating, for example, either an alarm or a test, the local controller 14 requests the stored information. This includes the reason for the off-normal condition, e.g. alarm or test, the strength of the received signal and the identification code of the sending transmitter. The local controller 14 also links the retrieved transmitter and signal information with an identification code associated with the receiver that is holding the information.

Several receivers, such as 92, 94 and 96, typically will receive, store and transfer information connected with a single alarm or test. The local controller 14 sends the information, including received signal strength, transmitter identification, and receiver identification, on to the alarm center 18. The alarm center uses the information, and any other information that might be received from other local controllers, to display on a monitor 100 icons and text representing the location of the detecting receivers. The alarm center also uses the information to calculate and display an icon representing the predicted location of the transmitting communicator.

If the off-normal condition is caused by an alarm, the local control center 14 and alarm center 18 will issue commands activating a sounder 102 and strobe 104 closest to the above-mentioned receivers. A horn 105 associated with each detecting receiver also is energized. If the off-normal condition is caused by a test, the alarm center 18 will use the unique identification of the portable transmitter to look in its records for an active subscriber, and will indicate the results of the test by energizing a green or red light emitting diode (LED) 106 or 108, respectively, on the detecting receivers. The red LED might be actuated, for example, to indicate an expired subscription, while the green LED would indicate a successful subscriber test.

Figure 6:
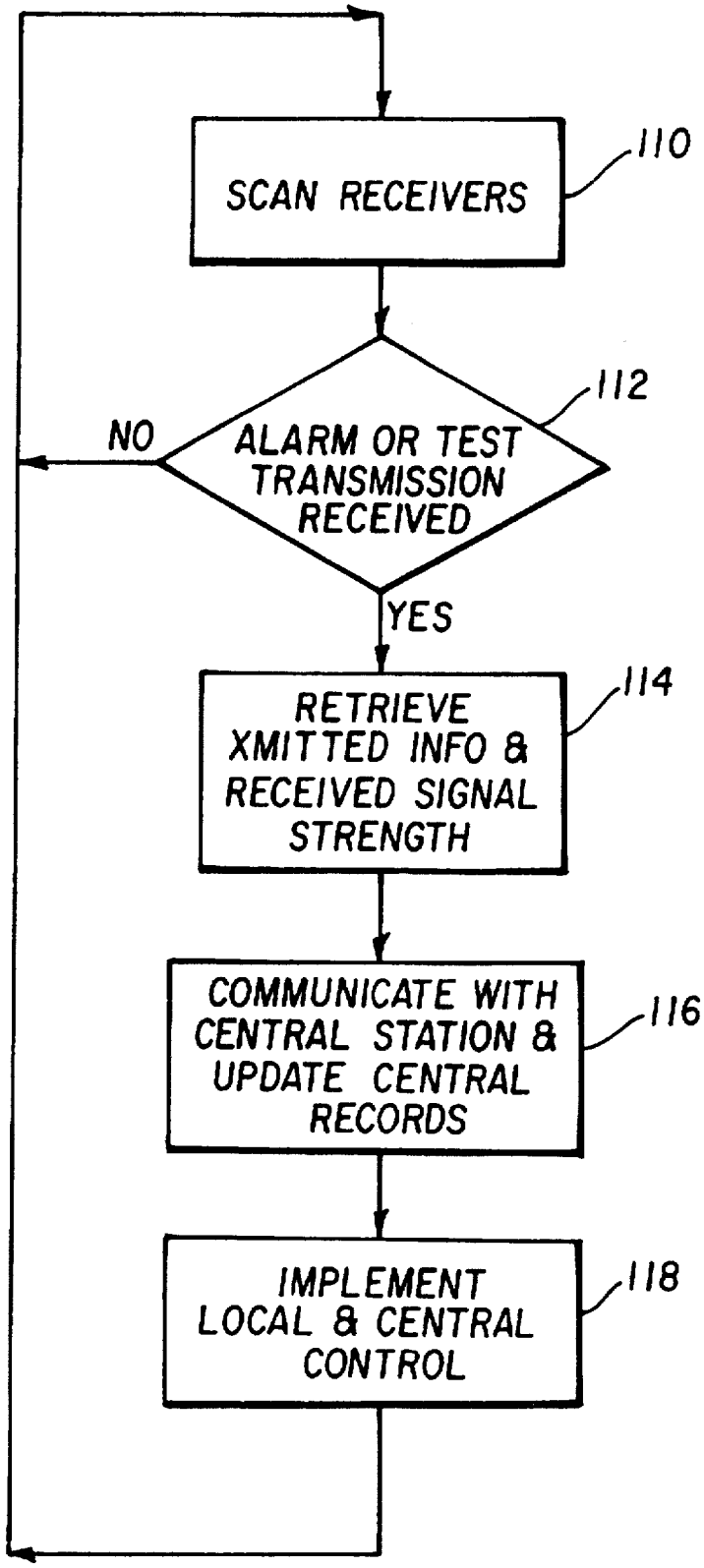
FIG. 6 is a is a flow diagram summarizing the operation of the preferred local controller.

The operation of a typical local controller is summarized as a flow diagram on FIG. 6. The receivers are scanned at 110. If the off-normal flag indicates that an alarm or test transmission was detected, 112, the information stored in the detecting receiver(s) is retrieved at 114, and the information in the strongest signals is forwarded to the alarm center at 116. The forwarded information includes the identification of the transmitting communicator, the identification of the detecting receiver and the received signal strength at the detecting receiver. The local controller then receives acknowledgments from the alarm center 18 and implements commands from the station at 118.

Central Monitoring Station

Alarm center 18 (FIG. 1) includes a transceiver 120 and computer 122 with monitor 100. The alarm center communicates with the local controllers 14 for actuating the sounders and strobes 102 and 104 in the alarm mode and the red and green LEDs 106 and 108 in the test mode. The alarm center also is used for entering system information and parameters. It might include a map of the protected area and a program for showing the locations of receivers in the vicinity of an alarm or test transmission. Typically, the alarm center will store subscriber records including active or inactive status, identification of the portable communicator assigned to each subscriber, and the times and locations from which it was used, either in an emergency or for a test.

The alarm center also locates and tracks any movement of a transmitting communicator as described more fully in the previously mentioned Berube and Reed patent application Ser. No. 08/635,986.

The alarm center displays alarm information in several ways. It displays icons representing the locations of the detecting receivers, it displays a predicted location of the transmitting communicator, and it displays text pertaining to some of the detecting receivers.

Receiver Icons

Icons are displayed by the alarm center representing all of the detecting receivers up to a maximum of six local controllers and fifteen receivers for each of the six local controllers. If the maximum is exceeded, the displayed icons are selected based on the strongest received signals. The displayed icons are presented on monitor 100 with a map or grid representing the protected area and depict the respective positions of the detecting receivers within the protected area.

Transmitter Predicted Location

Figures 8, 9:
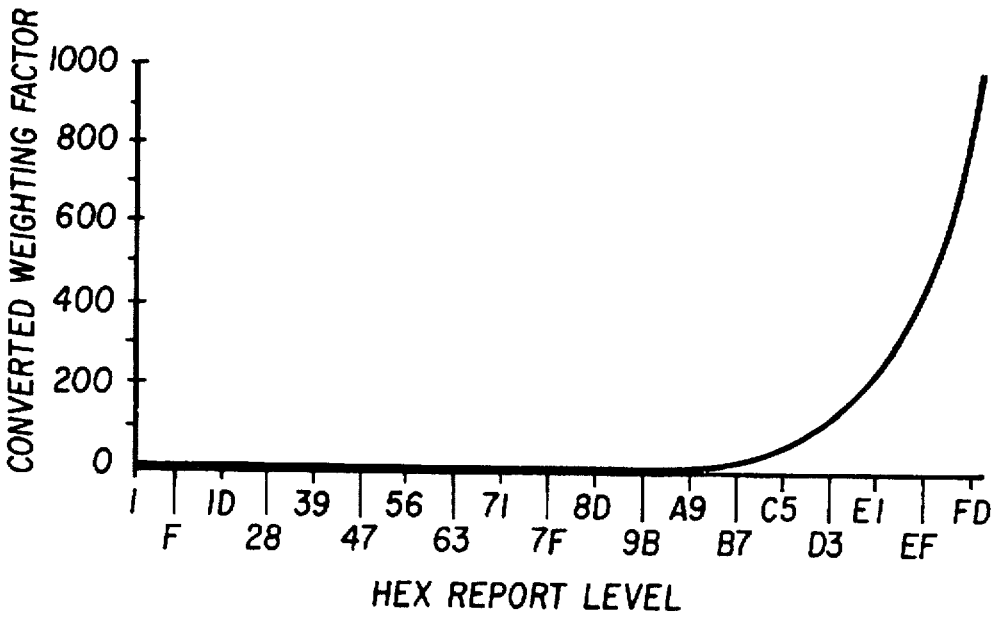
FIGS. 8 and 9, respectively, are a chart and graph of conversion factors according to the preferred embodiment.

The system also displays an icon on the map in a position representing the predicted location of the transmitting communicator. The predicted location is based on a weighted average using the known locations of the detecting receivers, and a converted weighting factor based on the received signal strength and a conversion table that exaggerates or magnifies the influence of signal strength. The "X" coordinate, for example, is determined as follows:

$$X_p=(C_1X_1+C_2X_2+C_3X_3+\ldots)/(C_1+C_2+C_3+\ldots)$$

Where $X_p$ is the predicted "X" coordinate of the transmitting communicator location, $X_1$, $X_2$, $X_3$, . . . are the known "X" coordinates of the respective detecting receivers, and $C_1$, $C_2$, $C_3$, . . . are the converted weighting factors determined according to the table of FIG. 8 for the respective detecting receivers. The conversion factors selected from the FIG. 8 table are represented graphically on FIG. 9. At lower signal strengths, the conversion factor is small, adding little to the weighting provided by the signal strength alone. At higher signal strengths the conversion factor increases much more rapidly than a straight line relationship, substantially increasing the influence of signal strength in the weighting. Strong signals dominate the weighted calculations.

Other coordinates of the predicted position are determined in a similar manor using the same conversion factors.

Text Pertaining to Detecting Receivers

Textual matter also is displayed providing information about the detecting receivers and their locations. The format of the displayed textual information also depends on the relative strength of the signals received by the detecting receivers. The system displays textual information, such as an identification and location, for the three detecting receivers that receive the strongest signals, subject to the following:

1. Text is displayed for all of the detecting receivers if there are less than three.

2. Text is displayed for less than three detecting receivers if one or more of the three strongest signals is lower than the levels allowed according to the table of FIG. 11.

3. Text is displayed for more than three detecting receivers if the weakest signal levels, otherwise displayed, are the same for two or more receivers. In this case the number displayed is determined by the space available in the text box.

The table of FIG. 11 depicts certain restrictions limiting the number of detecting receivers for which text is displayed. Again, the restrictions are based on relative signal strength. The strongest received signal is compared to the values in the left hand column. Corresponding values in the right hand column then determine minimums below which text is not displayed.

Figure 7:
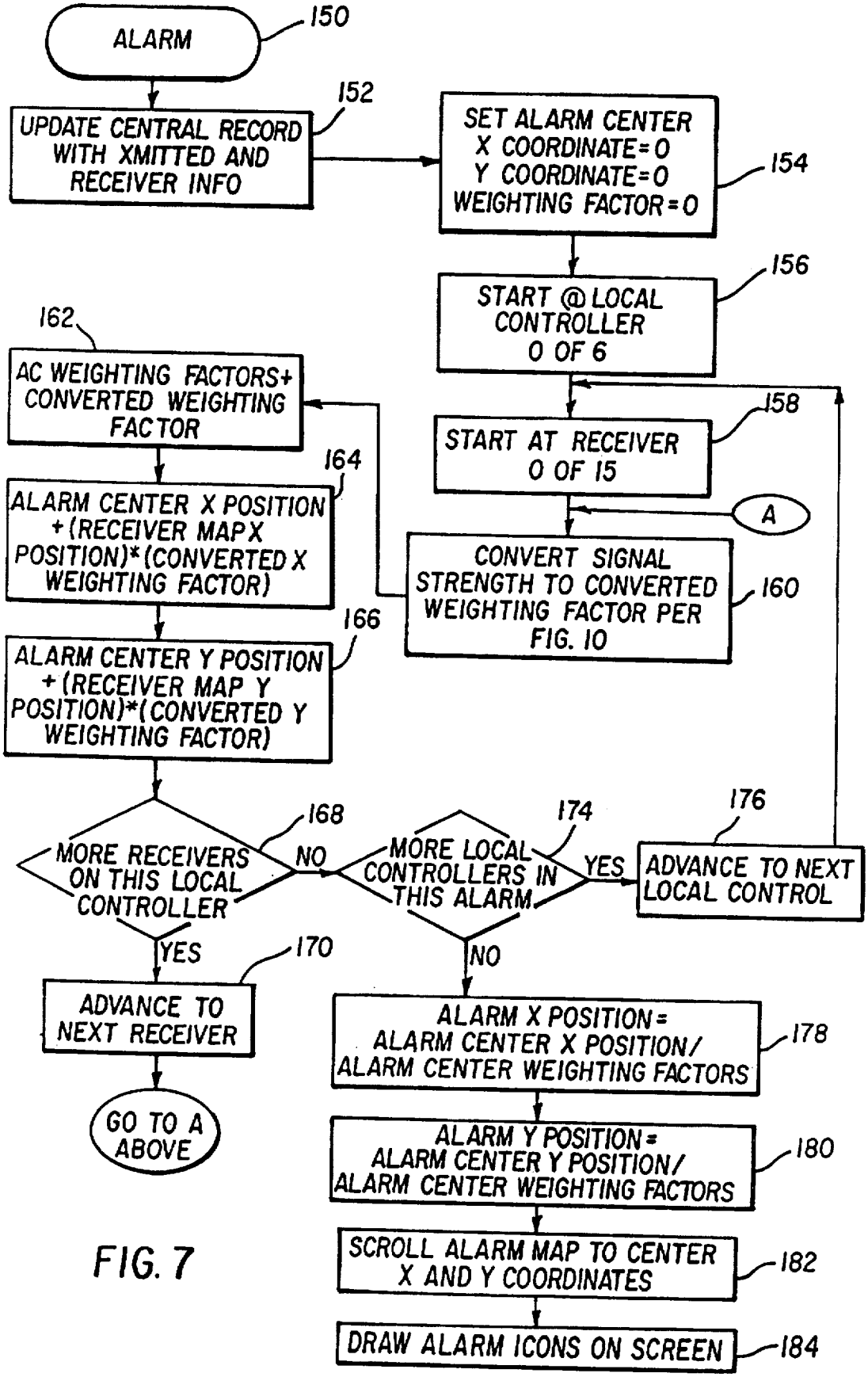
FIG. 7 is a flow diagram depicting the operation of the alarm center according to the preferred embodiment.

FIG. 7 depicts the operation of alarm center 18, according to the preferred embodiment, to determine the predicted position of a transmitting communicator. When an alarm is received, box 150, a central record is created or updated with the transmitted and receiver information, box 152, including the transmitter ID, receiver ID and received signal strength. The system resets any existing values to zero, box 154, and begins with the first receiver, boxes 156 and 158. The received signal strength at that receiver is converted to the converted weighting factor, box 160, according to the table of FIG. 10, and added to any previously stored weighting factors, box 162, to produce an alarm center (AC) weighting factor, which is the sum of all of the weighting factors up to that point in the calculations. For this first receiver, the alarm center weighting factor was reset to zero at box 154. The alarm center "X" and "Y" coordinates are then calculated, boxes 164 and 166. The converted X weighting factor is multiplied times the known X coordinate of the detecting receiver and the result is added to the alarm center X coordinate which, again, was set to zero in box 154. The alarm center Y coordinate is determined in a similar manner.

The above described process is repeated for each of the detecting receivers, boxes 168, 170, 172, 174 and 176. When completed, box 174, the predicted X and Y coordinates are determined by the weighted average, boxes 178 and 180, the map is scrolled to center the predicted coordinates, box 182, and the icon representing the predicted location of the transmitting alarm is drawn on the map, box 184.

Figure 10:
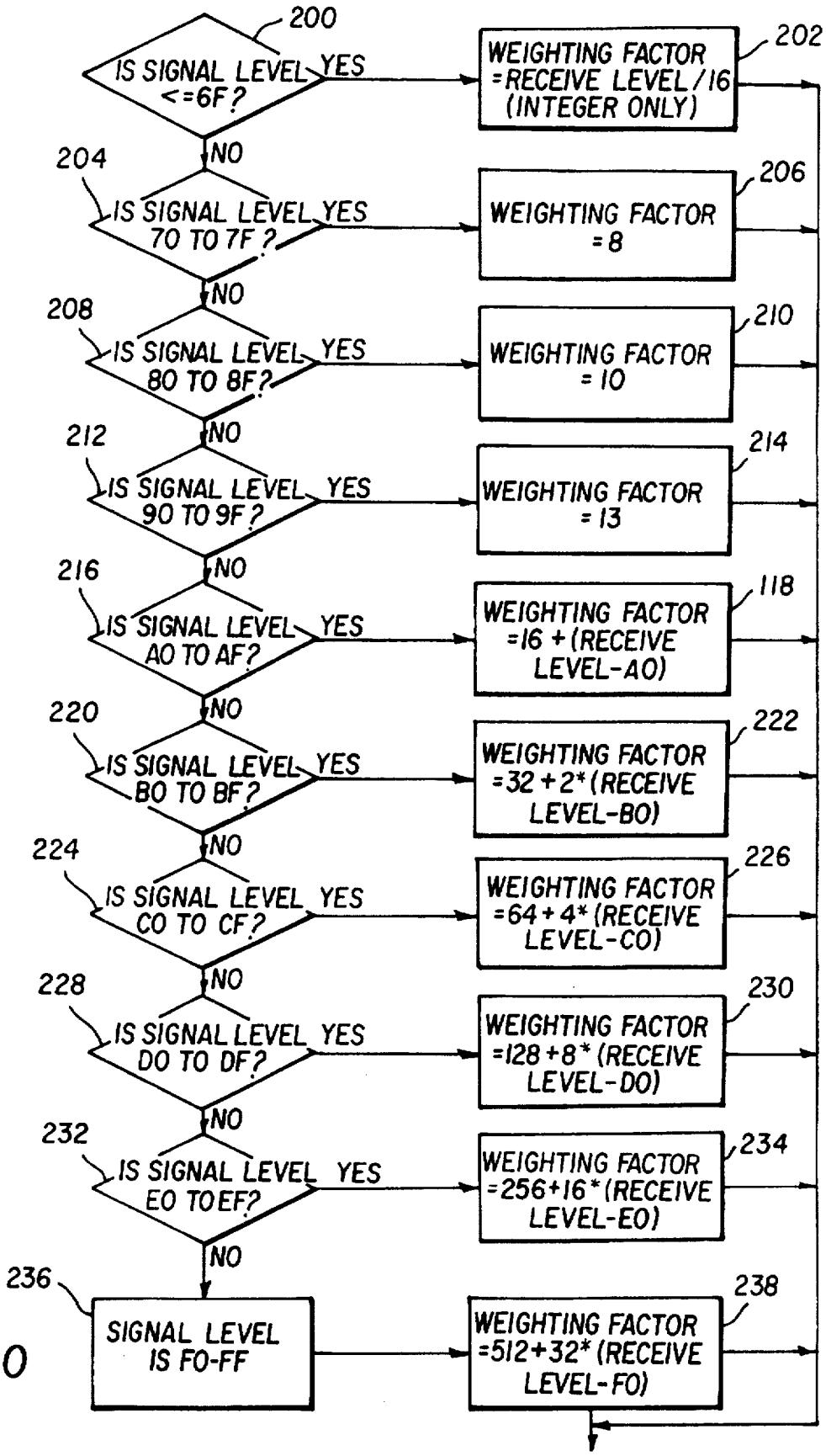
FIG. 10 is a flow diagram pertaining to the alarm center for implementing the conversion factors of FIGS. 8 and 9.

FIG. 10 is a flow diagram implementing the conversion factors depicted on the table of FIG. 8. If the signal level is less than 6F hexadecimal, it is converted to a decimal value equal to the hexadecimal value divided by sixteen (integer only), boxes 200 and 202. If the signal level is between 70 and 7F hexadecimal, it is converted to a decimal level of 8, boxes 204 and 206. If the signal level is between 80 and 8F hexadecimal, it is converted to a decimal level of 10, boxes 208 and 210. If the signal level is between 90 and 9F hexadecimal, it is converted to a decimal level of 13, boxes 212 and 214. If the signal level is between A0 and AF hexadecimal, it is converted to a decimal level of sixteen plus the receive level minus A0, boxes 216 and 218. If the signal level is between B0 and BF hexadecimal, it is converted to a decimal level of thirty two plus the receive level minus B0, boxes 220 and 222. If the signal level is between C0 and CF hexadecimal, it is converted to a decimal level of sixty four plus the receive level minus C0, boxes 224 and 226. If the signal level is between D0 and DF hexadecimal, it is converted to a decimal level of one hundred and twenty eight plus the receive level minus D0, boxes 228 and 230. If the signal level is between E0 and EF hexadecimal, it is converted to a decimal level of two hundred fifty six plus the receive level minus E0, boxes 232 and 234. Above a signal level of FO, the conversion factor is five hundred twelve plus the receive level minus F0, boxes 236 an 238.

It should now be apparent that the invention provides an improved personal security system using weighted averages that exaggerate or magnify the influence of signal strength for locating transmitting communicators. According to other features of the invention text is displayed containing information that is selected depending on the received signal strength.

While the invention is described in connection with a preferred embodiment, other modifications and applications will occur to those skilled in the art. The claims should be interpreted to fairly cover all such modifications and applications within the true spirit and scope of the invention.

I claim:

1. A personal security system having a portable transmitter manually actuatable to transmit wireless signals and a plurality of receivers in predetermined fixed positions detecting said signals, said system using a weighted average of the detecting receiver positions to locate said transmitter; characterized in that:

said weighted average includes: a) the signal strengths received by said respective receivers; and, b) conversion factors increasing with signal strength, said conversion factors exaggerating the influence of signal strength in the average.

2. A personal security system comprising:

a plurality of portable communicators, each respective communicator having a manual actuator for initiating transmission of wireless signals;

a plurality of receivers fixed in predetermined positions for detecting said transmissions, said detecting receivers communicating information from said signals including received signal strength; and, an alarm center receiving said information communicated by said detecting receivers and displaying the respective locations of a plurality of said detecting receivers, said plurality depending on a comparison of said received signal strengths, wherein said respective locations are displayed as text in alternative formats, and said alternative formats include text pertaining to: a) a predetermined number of said detecting receivers; b) a number of said detecting receivers less than said predetermined number when said signal strengths of said predetermined number vary by more than predetermined amounts; and c) a number of said detecting receivers more than said predetermined number when said signal strengths of said predetermined number vary by less than predetermined amounts.

* * * * *